United States Patent [19]

Chiarot

[11] Patent Number: 4,778,065

[45] Date of Patent: Oct. 18, 1988

[54] SKI RACK

[75] Inventor: John Chiarot, Weston, Canada

[73] Assignee: 716386 Ontario Limited, Weston, Canada

[21] Appl. No.: 53,810

[22] Filed: May 26, 1987

[51] Int. Cl.[4] ..... A47F 7/00

[52] U.S. Cl. ..... 211/70.5; 211/65

[58] Field of Search ..... 211/70.5, 60.1, 65, 211/88, 72, 70.8, 70.1, 67, 68, 70.6, 70.7, 65; D6/552, 553

[56] References Cited

U.S. PATENT DOCUMENTS

| | | | |
|---|---|---|---|
| 2,291,381 | 7/1942 | Drake | 211/70.6 X |
| 2,919,032 | 12/1959 | Sinawski | 211/70.5 |
| 3,187,902 | 6/1965 | Nelson | 211/70.6 |
| 3,349,922 | 10/1967 | Morrison | 211/113 |
| 3,472,389 | 10/1969 | Lowe | 211/70 |

FOREIGN PATENT DOCUMENTS

| | | | |
|---|---|---|---|
| 2085711 | 5/1982 | United Kingdom | 211/182 |

*Primary Examiner*—J. Franklin Foss
*Assistant Examiner*—Sarah A. Lechok Eley
*Attorney, Agent, or Firm*—Sim & McBurney

[57] ABSTRACT

A ski rack includes an upright back portion, and a substantially horizontal flange portion integral with the back portion. A slot extends through the flange portion at right angles to the back portion, and a pair of upright, spaced apart wall portions are provided at right angles to both the back portion and the flange portion. The wall portions are on either side of the slot and are integral with both the back and flange portions. The wall portions have a substantial extent in the vertical direction and a spacing such that a pair of skis located between them with the points upward can be retained and supported due to a double contact with the top and bottom of the wall portions.

13 Claims, 5 Drawing Sheets

SKI RACK

This invention relates generally to racks for skis, and has to do particularly with a ski rack construction suitable for use indoors, on which a plurality of pairs of skis can be hung vertically.

BACKGROUND OF THIS INVENTION

Brackets intended to be secured to walls and to support various articles in the vertical or hanging orientation are of course well known. However, there is a need for a ski rack which is able to receive and support pairs of skis in such a way that the skis do not need to be bound together before being placed in the rack.

GENERAL DESCRIPTION OF THIS INVENTION

Accordingly, it is a general aspect of this invention to provide a ski rack incorporating a construction defining slots in which pairs of skis can be suspended and retained in a vertical orientation, without first being bound or tied together.

It is another general aspect of this invention to provide a light-weight ski rack specially designed to store pairs of skis at the closest possible spacing in the lateral sense.

More particularly, this invention provides a ski rack which includes an upright back portion, and a substantially horizontal flange portion integral with the back portion. The flange portion has a slot substantially at right angles to the back portion, and a pair of upright, spaced apart wall portions substantially at right angles to both the back portion and the flange portion. The wall portions are located on either side of the slot and are integral with both the back portion and the flange portion. The wall portions have a substantial extent in the vertical direction and a spacing such that a pair of skis located therebetween with the points upward can be retained and supported due to a double contact with the top bottom of the wall portions.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
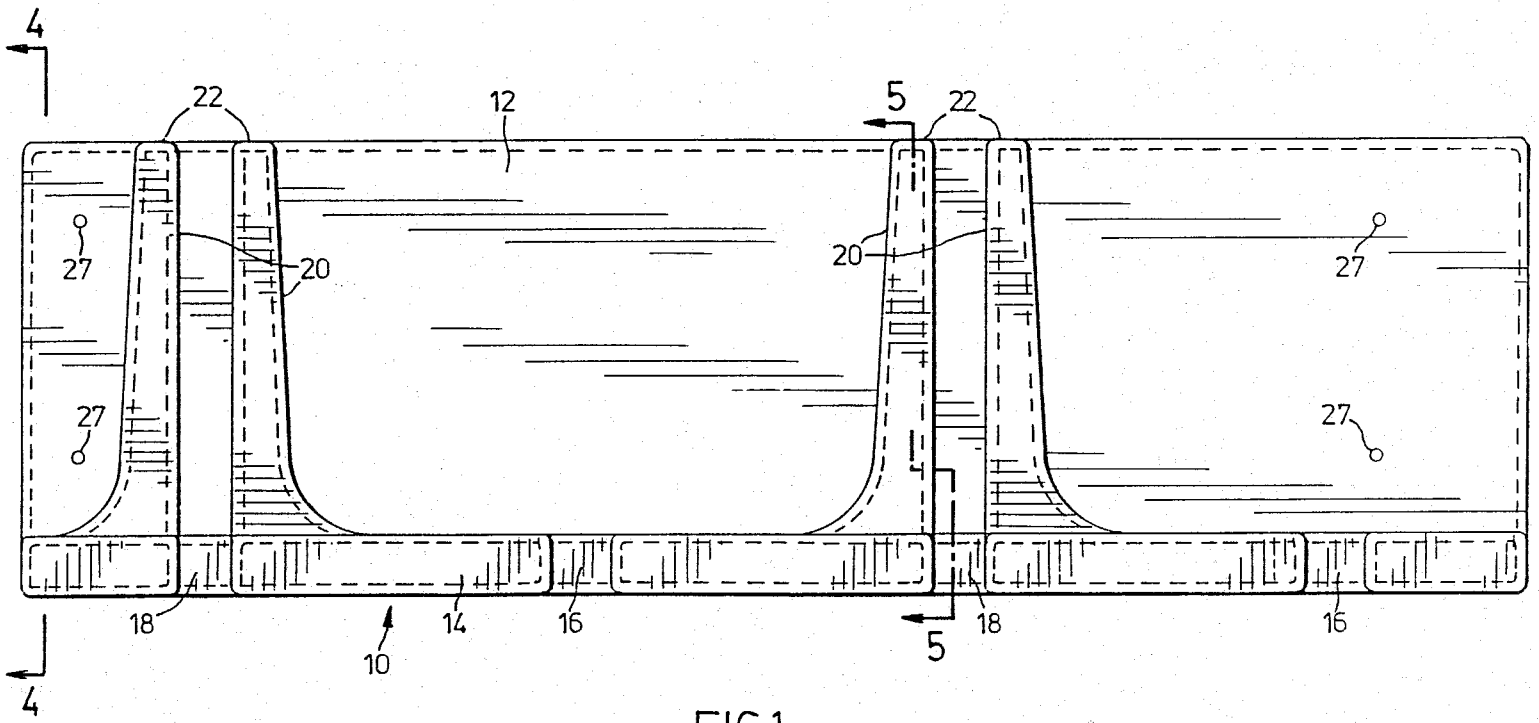
FIG. 1 is a front view of a ski rack constructed in accordance with this invention.
Figure 2:
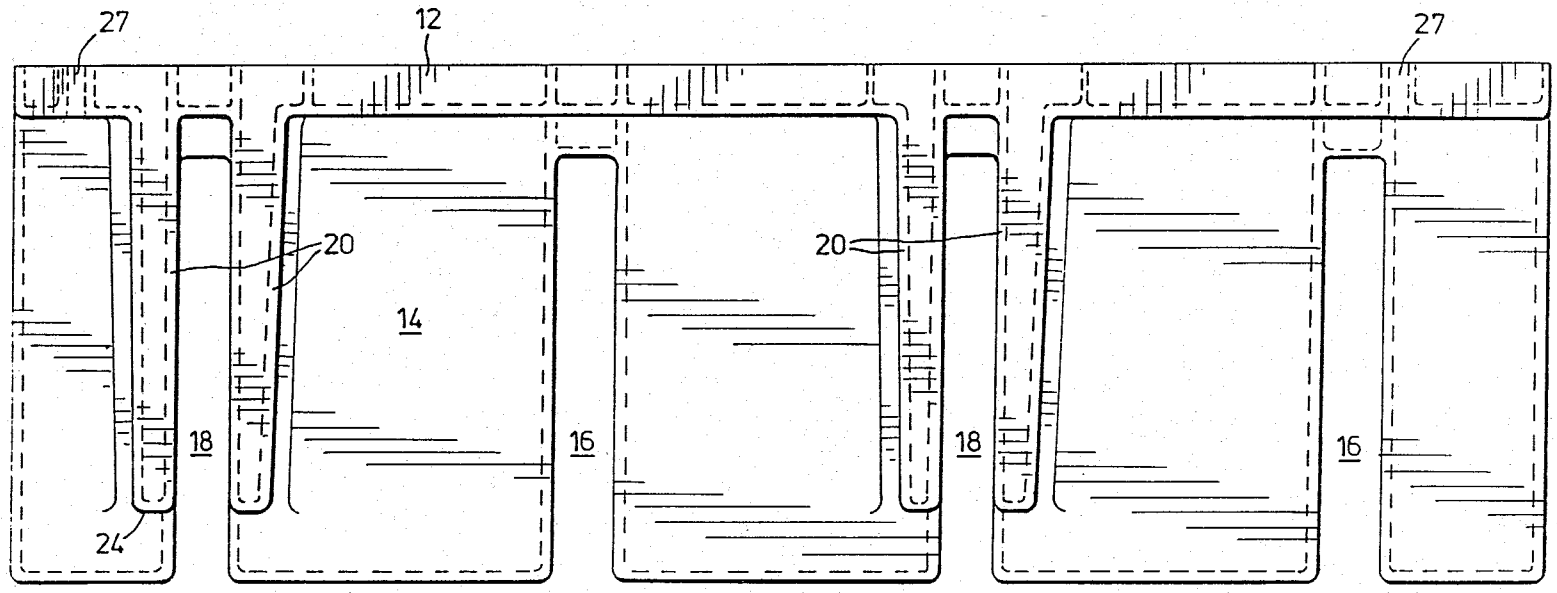
FIG. 2 is a top view thereof.
Figure 5:
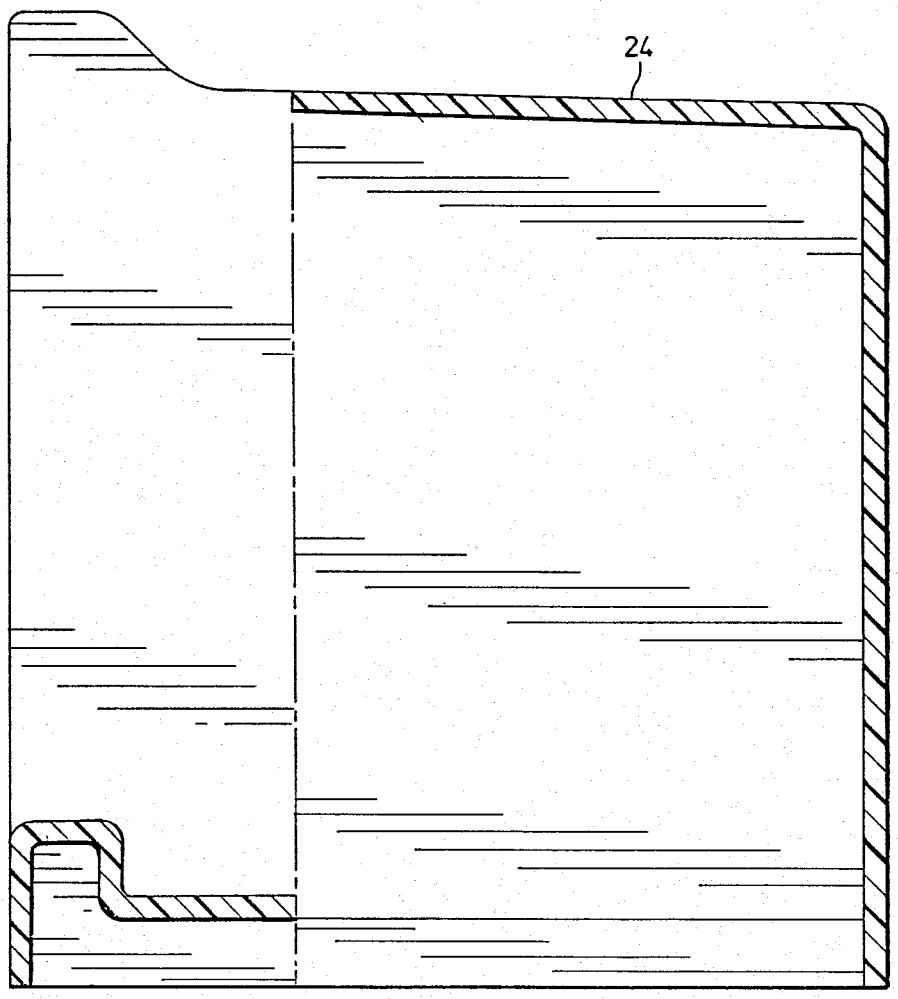
FIG. 5 is a sectional view taken at the line 5—5 in FIG. 1.

Attention is first directed to FIG. 1, which shows a ski rack generally at 10, including an upright back portion 12 and a horizontal flange portion 14. In the embodiment shown, the flange 14 contains two slots 16 at right angles to the back portion, and two further slots 18, also at right angles to the back portion 12. It will be noted that the slots 18 are defined by upstanding, approximately rectangular walls 20 each having a horizontal top edge 22, a downwardly and slightly forwardly sloping front edge 24 (FIG. 5), a rear edge merging with the back portion 12, and a bottom edge merging with the flange 14.

As can be seen in the figures, the walls 20 are upwardly tapered when seen in front elevation. This results in the slots 18 being upwardly divergent, as best seen in FIG. 1. The taper is useful when the ski rack is molded by injection molding from plastic or similar material. To facilitate the molding, the back portion 12, the flange 14 and the walls 20 are all of hollow design. Moreover, the flange 14 is open rearwardly, i.e. it is possible to have direct access to the interior of the walls 20 from the back of the ski rack.

Figure 3:
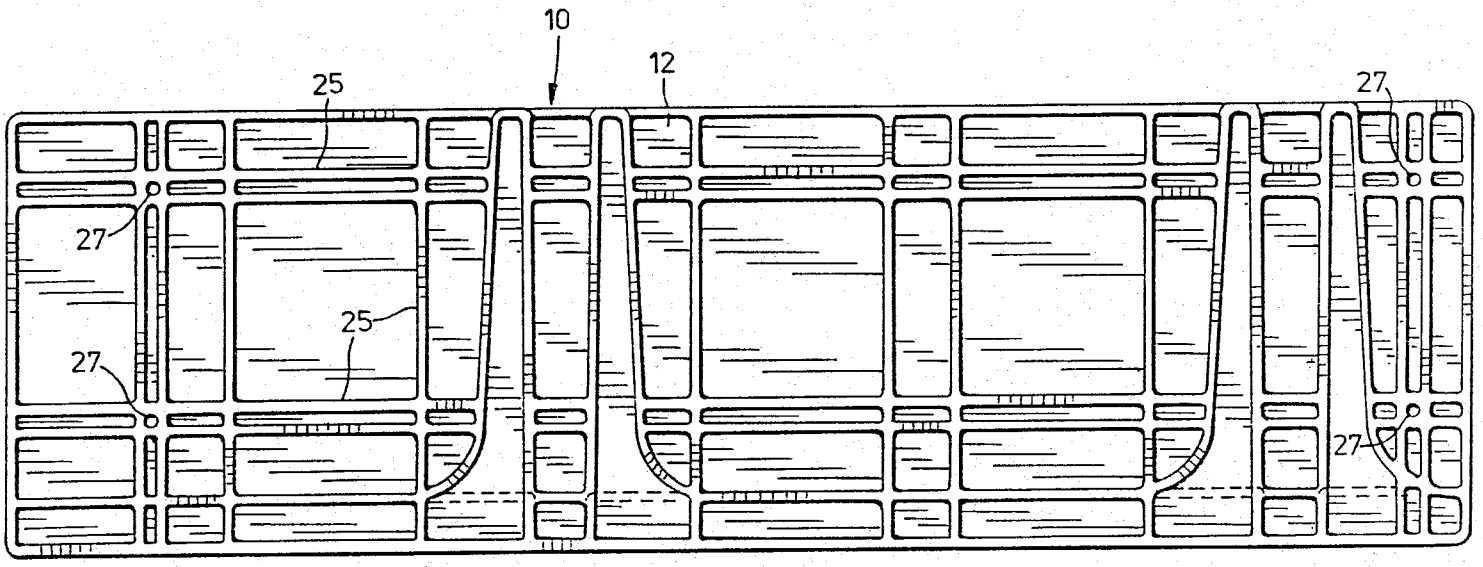
FIG. 3 is a rear elevational view thereof.
Figure 4:
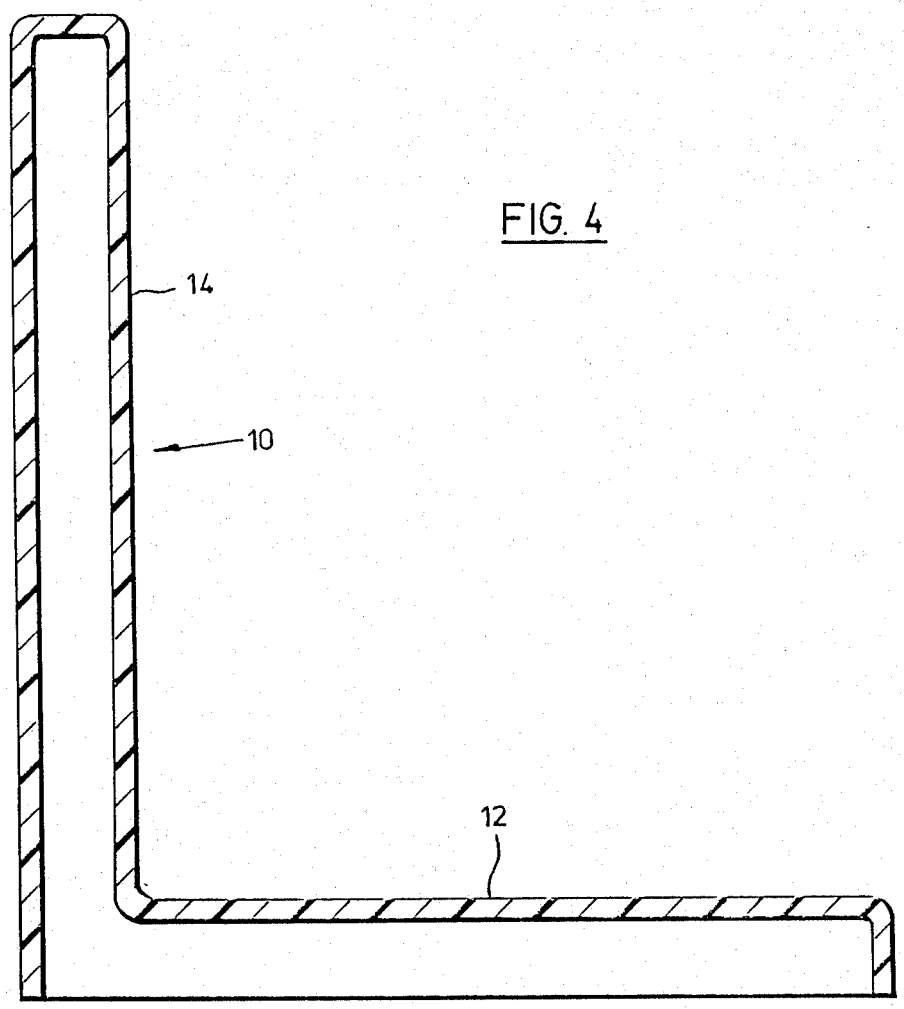
FIG. 4 is a sectional view taken at the line 4—4 in FIG. 1.

As well seen in FIG. 3, the ski rack in its preferred embodiment includes ribbing 25 to improve the strength and rigidity of the item.

The design that has been described has a number of advantages which will now be discussed. The provision of the tall vertical parallel walls 20 defining each slot 18 permits the user to hang a pair of skis, particularly cross country skis, without first having to tie the skis together. The height of the walls 20 prevents the skis from slipping through due to the fact that each ski has two outside points of contact with each wall, one point above the other.

By providing staggered slot heights (the slots 16 are below the upper opening of the slots 18), it is possible to accommodate adjacent pairs of skis within the shortest distance between each pair. In other words, the points of one pair of skis do not lie at the same level and interfere with the points of adjacent pair of skis. With the arrangement shown in FIG. 1, for example, one could store two pairs of cross country skis in slots 18 and two pairs of alpine skis in the slots 16. Alternatively, one could store two pairs of cross country skis in the tall slots 18 and ski poles in the bottom slots 16. Again, one could store two pairs of alpine skis on the bottom slots and ski poles on the top slots.

By making the ski rack of plastic, it is possible to avoid scratching skis when placing and removing them from the rack. Further, the plastic can be selected to be non-corrosive, of light weight, and of low cost. Since the ski rack is of one-piece or integral construction, it is easily cleaned. The light weight arises from the fact that the construction is hollow.

A number of suitable plastic materials could be selected, such as polypropylene, high density polyethylene, and others. The plastics may be thermoplastic or thermosetting. The structure shown in the drawings is also suitable for the use of structural foam, for example Lexan with a foaming agent.

It will be evident that a plurality of hangers constructed in accordance with the drawings can be arranged one beside the other in a long row to accommodate many pairs of skis, for example in a ski lodge area outside or inside for skiers to hang their skis while they are not skiing.

In the drawings, there are shown mounting holes 27 which conveniently can be placed 16" apart so as to make the rack suitable for mounting on a stud wall construction in North America, where the studs are typically 16" apart.

While the simpler slots 16 are not capable by themselves of preventing unbound skis from slipping through, it will be understood that most brake systems on alpine skis allow the skis to be clamped together quickly and easily, and thus the simpler slots 16 are ideal for alpine skis of this construction.

It has been pointed out above that retention of a pair of skis in the tall slots 18 comes about due to the fact that each ski has two outside points of contact with each wall 20, one point above the other. It will be appreciated that, in order to ensure such retention, the width of the each slot 18 must be selected by taking into account the overall height of the walls 20. Thus, the taller the walls 20, the larger may be the width of the slot 18 while still retaining a pair of typical skis. However, for reasons of economy, it is obviously desirable to reduce the height of the walls 20 to the lowest value, consistent with reliability. It has been found that, with a height of approximately 5¾" for the walls 20, the width of the slot 18 at the bottom should be approximately 17 mm, diverging upward to 18 mm at the top. A width of 17 mm at the bottom is large enough to ensure that virtually all typical cross country skis can fit between the walls. As has already been pointed out, an increase in the height of the walls 20 would permit an increase in the minimum width of the slot 18, and therefore this invention is not considered restricted to any specific dimensions or ratios.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A ski rack comprising:

an upright back portion, a substantially horizontal flange portion integral with the back portion, a slot-through the flange portion substantially at right angles to the back portion, and a pair of upright, spaced apart wall portions substantially at right angles to both the back portion and the flange portion, the wall portions being on either side of said slot and being integral with both the back portion and the flange portion, the wall portions extending at least about 5.75 inches in the vertical direction and being spaced apart by at least about 17 mm, such that a pair of skis located therebetween with the points upward can be retained and supported due to a double contact with the top and bottom of the wall portions.

2. The invention claimed in claim 1, in which the back portion has a top edge and a bottom edge, and in which the flange portion extends outward from the bottom edge of the back portion.

3. The invention claimed in claim 2, in which the wall portions have a vertical height substantially equal to the height of the back portion, and are coextensive therewith.

4. The invention claimed in claim 1, in which all parts of the ski rack are of hollow construction, in order to reduce weight and amount of material used.

5. The invention claimed in claim 1, in which the ski rack is molded from plastic material.

6. The invention claimed in claim 3, in which all parts of the ski rack are of hollow construction, in order to reduce weight and amount of material used.

7. The invention claimed in claim 6, in which the ski rack is molded from plastic material.

8. The invention claimed in claim 3, in which the facing surfaces of the wall portions are slightly upwardly diverging.

9. The invention claimed in claim 3, in which there are at least two said slots spaced apart along said flange.

10. The invention claimed in claim 9, in which the said flange further further exhibits at least one further slot at substantial right angles to the back portion and spaced form said first-mentioned slots, said at least one further slot being without upright wall portions.

11. The invention claimed in claim 10, in which there are two slots with wall portions and two slots without wall portions.

12. The invention claimed in claim 4, in which the back portion and the flange portion are both open toward the rear, and in which the back portion is provided with ribs for purposes of strengthening and rigidifying the ski rack.

13. The invention claimed in claim 1, in which the height of the wall portions is substantially 5¾", and in which the minimum spacing between the wall portions is substantially 17 mm.

* * * * *